US011872450B2

(12) United States Patent
Wang et al.

(10) Patent No.: US 11,872,450 B2
(45) Date of Patent: Jan. 16, 2024

(54) MARK BALL SPECIAL FOR GOLF HIGH-SPEED CAMERA SENSOR

(71) Applicant: SHENZHEN GREENJOY TECHNOLOGY CO., LTD., GuangDong (CN)

(72) Inventors: Ji Jun Wang, GuangDong (CN); Qing Hua Wang, GuangDong (CN)

(73) Assignee: SHENZHEN GREENJOY TECHNOLOGY CO., LTD., GuangDong (CN)

( * ) Notice: Subject to any disclaimer, the term of this patent is extended or adjusted under 35 U.S.C. 154(b) by 279 days.

(21) Appl. No.: 17/483,817

(22) Filed: Sep. 24, 2021

(65) Prior Publication Data

US 2022/0032126 A1 Feb. 3, 2022

Related U.S. Application Data

(63) Continuation of application No. PCT/CN2020/131289, filed on Nov. 25, 2020.

(30) Foreign Application Priority Data

Jul. 29, 2020 (CN) ..... 202010741630.X

(51) Int. Cl.
*A63B 37/00* (2006.01)
*A63B 24/00* (2006.01)

(52) U.S. Cl.
CPC ..... *A63B 37/0022* (2013.01); *A63B 24/0021* (2013.01); *A63B 2024/0034* (2013.01); *A63B 2220/05* (2013.01); *A63B 2220/807* (2013.01)

(58) Field of Classification Search
CPC ..... A63B 37/0022; A63B 24/0021; A63B 2024/0034; A63B 2220/05;
(Continued)

(56) References Cited

U.S. PATENT DOCUMENTS 141,546 A * 8/1873 Dayton
676,506 A * 6/1901 Knight et al.
(Continued)

FOREIGN PATENT DOCUMENTS

CN 102316940 1/2012
CN 103630117 3/2014
(Continued)

OTHER PUBLICATIONS

"International Search Report (Form PCT/ISA/210) of PCT/CN2020/131289," dated Apr. 25, 2021, pp. 1-4.
(Continued)

*Primary Examiner* — Nini F Legesse
(74) *Attorney, Agent, or Firm* — COOPER LEGAL GROUP, LLC

(57) ABSTRACT

The present application relates to a mark ball special for a golf high-speed camera sensor. The mark ball includes a sphere. A mark portion is provided on a surface of the sphere, the mark portion includes a plurality of marks that are arranged along a circumferential direction of the sphere and shaped different from each other. A plurality of different marks are arranged on a golf mark ball such that a high-speed camera sensor can capture diversified images of the ball.

3 Claims, 1 Drawing Sheet

(58) Field of Classification Search
CPC ..... A63B 2220/807; A63B 69/3658; A63B 2220/806; A63B 43/008; A63B 45/02; A63B 2024/0028; A63B 2102/32
USPC ..... 473/151, 199, 200, 219, 198, 254, 280, 473/378
See application file for complete search history.

(56) References Cited

U.S. PATENT DOCUMENTS

| | | | | |
|---|---|---|---|---|
| 4,867,450 | A * | 9/1989 | Katz | A63B 69/38 473/459 |
| 5,067,719 | A * | 11/1991 | Mook | A63B 69/3655 473/200 |
| 5,564,707 | A * | 10/1996 | Dinh | A63B 45/02 473/270 |
| 6,390,934 | B1 * | 5/2002 | Winfield | A63B 69/3658 382/169 |
| 7,691,005 | B2 * | 4/2010 | Mitsuba | A63B 37/0022 D21/708 |
| 8,328,653 | B2 * | 12/2012 | Lock | A63B 24/0003 473/409 |
| 9,149,701 | B1 * | 10/2015 | Bramlette | A63B 69/0071 |
| 9,168,443 | B2 * | 10/2015 | Edison | A63B 45/02 |
| 2002/0086741 | A1 | 7/2002 | Newcomb | |
| 2008/0020865 | A1 | 1/2008 | Mitsuba | |
| 2008/0293520 | A1 * | 11/2008 | Brown | A63B 43/008 473/604 |
| 2010/0210377 | A1 * | 8/2010 | Lock | A63B 69/3658 473/409 |
| 2011/0065530 | A1 | 3/2011 | Molinari et al. | |
| 2014/0166196 | A1 | 6/2014 | Flynn | |

FOREIGN PATENT DOCUMENTS

| | | | |
|---|---|---|---|
| CN | 103630117 | A | 3/2014 |
| CN | 106643662 | | 5/2017 |
| CN | 111888736 | | 11/2020 |
| CN | 212416889 | | 1/2021 |
| JP | 2001304830 | A | 10/2001 |
| JP | 2010540036 | A | 12/2010 |
| KR | 100881452 | | 2/2009 |
| KR | 20110006425 | | 6/2011 |
| KR | 101240502 | B1 | 3/2013 |

OTHER PUBLICATIONS

"Written Opinion of the International Searching Authority (Form PCT/ISA/237) of PCT/CN2020/131289," dated Apr. 23, 2021, pp. 1-5.

European Search Report cited in EP 20923692.6 dated Apr. 11, 2022, 4 pages.

* cited by examiner

MARK BALL SPECIAL FOR GOLF HIGH-SPEED CAMERA SENSOR

CROSS-REFERENCE TO RELATED APPLICATION

The present application is a continuation of international application of PCT application No. PCT/CN2020/131289 filed on Nov. 25, 2020, which claims the priority benefit of China application No. 202010741630.X filed on Jul. 29, 2020. The entirety of each of the above-mentioned patent applications is hereby incorporated by reference herein and made a part of this specification.

BACKGROUND

Technical Field

The present application relates to a golf ball, especially to a mark ball special for golf high-speed camera sensor.

Description of Related Art

In order to improve golf skills, a hitter usually may use a high-speed camera sensor to capture and monitor the ball, so as to analyze a flight trajectory of the ball according to the captured images and improve the striking actions. Some existing golf balls are designed with characters and patterns, however, for branding or aesthetic effects. Such designs have no any special help in the recognition of the movement track of the ball. As a result, a novel and unique MARK ball is desirable to facilitate analyzing of the track of the ball.

SUMMARY

In order to solve the above technical problem, the present application provides a golf mark ball with improved marking arrangements.

In the technical solution of the present application for solving the technical problem, a mark ball special for a golf high-speed camera sensor includes a sphere. A mark portion is provided on a surface of the sphere, and the mark portion includes a plurality of marks that are arranged along a circumferential direction of the sphere and shaped different from each other.

The mark ball special for a golf high-speed camera sensor as described above, the mark portion includes a first mark group and a second mark group, and each of the first mark group and the second mark group includes two marks. Each mark in the first and second mark groups includes an upper portion, a middle portion and a lower portion, and the middle portions of all the marks are identical. The upper portions of the marks in the first mark group are identical and the lower portions of the marks in the first mark group are different. The upper portions of the marks in the second mark group are identical and the lower portions of the marks in the second mark group are different. The upper portions of the marks in the first mark group are different from the upper portions of the marks in the second mark group.

The mark ball special for a golf high-speed camera sensor as described above, each of the middle portions of all the marks is a strip corresponding to one circumferential direction.

The mark ball special for a golf high-speed camera sensor as described above, the upper portion of each mark in the first mark group is an oblique strip inclined in a first direction, and the upper portion of each mark in the second mark group is an oblique strip inclined in a second direction.

The mark ball special for a golf high-speed camera sensor as described above, the lower portions of two marks in the first mark group and the second mark group are respectively a longitudinal strip and a transverse strip.

In one aspect, the present application can bring beneficial effect as below. A plurality of different marks are arranged on the surface of the mark ball, by means of which the sphere of the ball in its flight path can present different views, hence a player is provided with clearer track data that helps improve his skills.

BRIEF DESCRIPTION OF THE DRAWINGS

Embodiments of the present application will now be described in detail below, by way of example and not limitation, with references to the accompanying drawings, in which like references indicate the same or similar parts or portions. Those skilled in the art should understand that the figures are not necessarily drawn to scale.

DESCRIPTION OF THE EMBODIMENTS

In order to make the objects, technical solutions, and advantages of embodiments of the present application clearer, the technical solutions of the embodiments of the present application will be described clearly and completely in conjunction with the accompanying drawings of the embodiments of the present application. Obviously, the described embodiments are a part rather than all the embodiments.

On the basis of the described embodiments of the present application, all other embodiments obtained by a person of ordinary skill in the art without inventive efforts shall fall within the scope of the present application. Unless otherwise defined, the technical or scientific terms used in the present disclosure shall have the usual meanings understood by those with ordinary skills in the field to which the present application belongs.

The "first", "second" and similar words used in the present disclosure do not indicate any order, quantity, or importance, but are only used to distinguish different components. Similarly, articles like "a", "an" or "the" do not limit in terms of quantity, but rather indicate that there is at least one. Verbs like "include" or "comprise" and others mean that the element or item preceding the verb covers the elements or items listed after the verb and their equivalents but does not exclude other elements or items. Verbs like "connected" or "coupled" are not limited to physical or mechanical connections, but may include electrical connections, whether direct or indirect. Adjectives like "upper", "lower", "left" and "right" are only used to indicate a relative position relationship, if the absolute position of the described object changes, the relative position relationship may also change accordingly.

Figure 1:
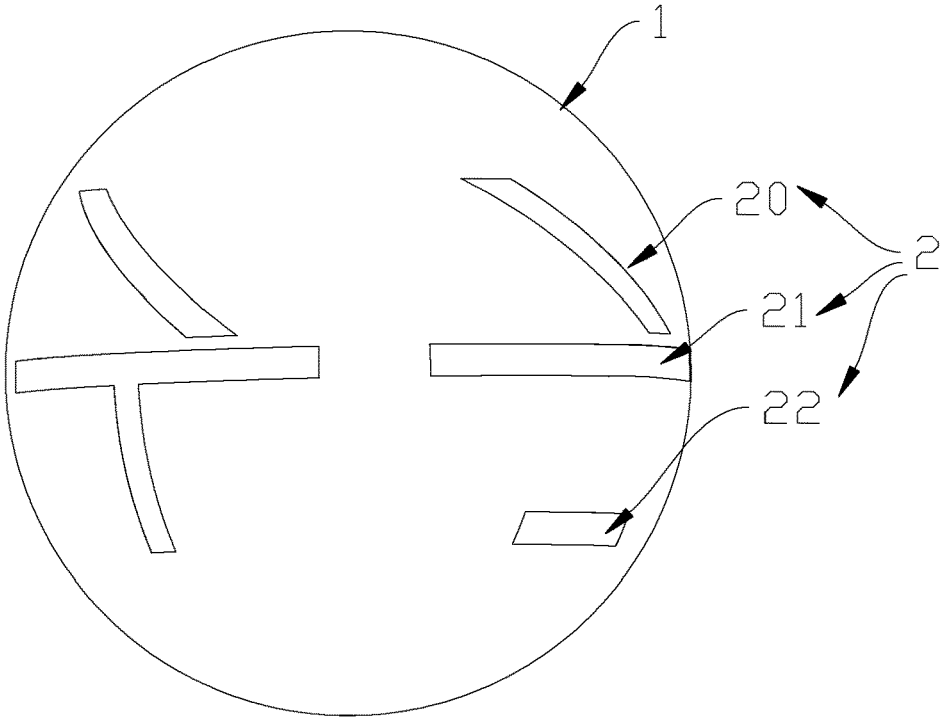
FIG. 1 is a schematic view from a first perspective according to an embodiment of the present application (showing a first mark group)
Figure 2:
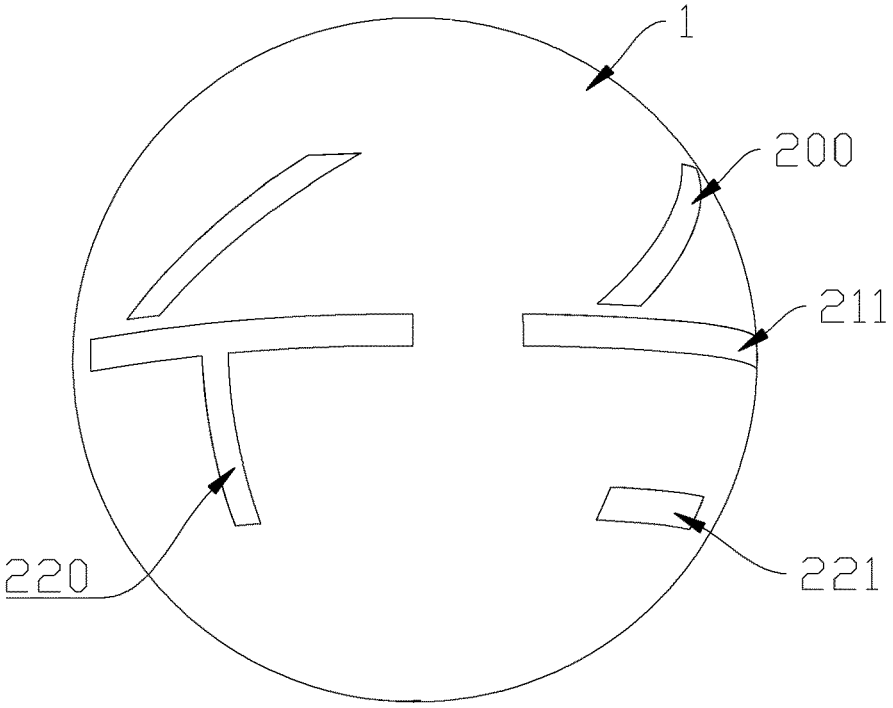
FIG. 2 is a schematic view from a second perspective according to an embodiment of the present application (showing a second mark group).

Referring to FIGS. 1 and 2, a mark ball special for a golf high-speed camera sensor includes a sphere 1. A mark portion is provided on a surface of the sphere 1. The mark portion includes a plurality of marks 2 that are arranged in a circumferential direction of the sphere 1 and shaped different from each other.

Since a plurality of different marks are arranged on the sphere 1, images of the ball captured with the high-speed camera sensor in its flight may present different image contents because of the different marks 2. In the case of unitary marks 2, the captured images of the sphere 1 in its flight path are repeat images, which is disadvantageous for the analysis of parameter changes relating to, for example, rotation, orientation and the like of the sphere 1 in its flight.

In an embodiment, the mark portion includes four marks 2, two in one group, that is, a first mark group and a second mark group are provided. Each of the marks 2 in each of the two mark groups includes three portions, that is, an upper portion 20, a middle portion 21 and a lower portion 22, which are arranged in upper, middle and lower positions as the name implies. All the four marks 2 in the two mark groups have the same middle portion 21. The two marks 2 in the first mark group and the two marks 2 in the second mark group respectively have same upper portions 20 and different lower portions 22. In other words, the two marks 2 in the first mark group have the same upper portions 20 and different lower portions 22, and the two marks 2 in the second mark group also have the same upper portions 20 and different lower portions 22. Further, the upper portions of the two marks 2 in the first mark group are different with the upper portions of the two marks 2 in the second mark group.

Therefore, four different marks 2 are formed on the surface of the sphere 1 along an equator thereof. The four different marks are preferably uniformly arranged, that is, the marks are arranged at angles of 0 degree, 90 degree, 180 degree and 270 degree. Thus, different views can be obtained when observing the sphere from respective directions, so that the high-speed camera sensor can capture different image data of the sphere 1, which optimizes the recognition and analysis of the flight path of the ball.

Specifically, the middle portion 21 of each mark 2 is a strip 210, and the strips 210 of all the marks 2 extend in a direction corresponding to one circumferential direction. Further, the upper portions 20 of the two marks 2 in the first mark group are oblique strips 200 inclined in a first direction, and the upper portions 20 of the two marks 2 in the second mark group are oblique strips 200 inclined in a second direction. Further, the lower portions 22 of the two marks 2 in the first mark group and the lower portions 22 of the two marks 2 in the second mark group are respectively a longitudinal strip 220 and a transverse strip 221. That is, the lower portions 22 of the two marks 2 in any one mark group include one longitudinal strip 220 and one transverse strip 221.

The mark 2 with a strip structure is simple and easy to implement, diversified patterns of marks 2 can be formed readily through different orientations of the strip structures, and clearer recognition of the picture captured can be facilitated. To simplify the process and reduce costs, the mark with the strip structure may be provided in the form of a coating or otherwise.

In summary, in the present application, a plurality of different marks 2 are provided on a golf mark ball, such that diversified images of the sphere 1 can be captured by the high-speed camera sensor. Thus, a player can analyze and reference the flight trajectory more accurately and improve his skills on this basis.

Although particularly shown and described with reference to preferred embodiments thereof, the present application is not limited thereto. It should be understood by those skilled in the art that various changes, combinations and variations are possible for the invention. It is intended that the present application cover the modifications and variations of this invention provided they come within the spirit and scope of the appended claims.

What is claimed is:

1. A mark ball special for a golf high-speed camera sensor, the mark ball comprising a sphere, wherein a mark portion is provided on a surface of the sphere, the mark portion comprises a first mark group and a second mark group, and each of the first mark group and the second mark group comprises two marks;

each mark in the first mark group and the second mark group comprises an upper portion, a middle portion and a lower portion, and the middle portions of all the marks are identical;

the upper portions of the marks in the first mark group are identical and the lower portions of the marks in the first mark group are different;

the upper portions of the marks in the second mark group are identical and the lower portions of the marks in the second mark group are different;

the upper portions of the marks in the first mark group are different from the upper portions of the marks in the second mark group; and each of the middle portions of all the marks is a strip corresponding to one circumferential direction of the sphere.

2. The mark ball special for a golf high-speed camera sensor according to claim 1, wherein the upper portion of each mark in the first mark group is an oblique strip inclined in a first direction, and the upper portion of each mark in the second mark group is an oblique strip inclined in a second direction.

3. The mark ball special for a golf high-speed camera sensor according to claim 2, wherein the lower portions of the two marks in the first mark group and the lower portions of the two marks in the second mark group are respectively a longitudinal strip and a transverse strip.

* * * * *